US005178451A

United States Patent [19]

Henry

[11] Patent Number: 5,178,451

[45] Date of Patent: Jan. 12, 1993

[54] PLASTIC CONTAINER FOR HOLDING WATER AND A CANDLE FOR USE IN A LUMINARIA

[75] Inventor: John J. Henry, Downingtown, Pa.

[73] Assignee: JH Specialties Inc., Exton, Pa.

[21] Appl. No.: 631,636

[22] Filed: Dec. 21, 1990

[51] Int. Cl.[5] ..... F21L 19/00; F21V 35/00; B65D 77/00

[52] U.S. Cl. ..... 362/161; 431/297; 206/216

[58] Field of Search ..... 431/288, 145, 289, 295, 431/297, 291, 310; 362/161; 383/127, 902; 206/216, 205, 212, 573, 575, 562, 563, 446, 223

[56] References Cited

U.S. PATENT DOCUMENTS

| | | | |
|---|---|---|---|
| 3,797,643 | 3/1974 | Shupp | 206/576 X |
| 4,163,333 | 8/1979 | Kwiatkowski | 362/161 X |
| 4,286,710 | 9/1981 | Higgins | 206/575 X |
| 4,544,351 | 10/1985 | Marsicano | 431/288 |
| 4,600,592 | 7/1986 | Dobis | 206/575 X |
| 4,818,214 | 4/1989 | Ronnback | 431/289 X |
| 4,937,701 | 6/1990 | Schroder | 362/161 |
| 4,938,688 | 7/1990 | Wexler | 431/295 |

FOREIGN PATENT DOCUMENTS

| | | | |
|---|---|---|---|
| 328329 | 4/1930 | United Kingdom | 215/6 |

*Primary Examiner*—Paul T. Sewell
*Assistant Examiner*—Beth Anne Cicconi
*Attorney, Agent, or Firm*—John F. A. Earley; John F. A. Earley, III

[57] ABSTRACT

A hollow plastic container for holding water and a candle for use in a luminaria comprises a bottom wall, a top wall, four side walls extending between the bottom wall and the top wall, and a candle securing member for securing the candle in an upright position in the container, the candle securing member including a well formed in the bottom wall into which the candle is inserted, the top wall having an opening above and aligned with the well to permit the candle to be inserted into the well, to permit the candle to extend from the container, and to permit insertion of water into the container. In use, the flame of the candle is automatically extinguished when the candle burns down to the point where the water held in the container contacts the flame.

21 Claims, 1 Drawing Sheet

PLASTIC CONTAINER FOR HOLDING WATER AND A CANDLE FOR USE IN A LUMINARIA

BACKGROUND OF THE INVENTION

1. Field of the Invention

This invention relates to luminarias, and more specifically concerns (a) a plastic container for holding water and a candle for use in a luminaria and (b) a luminaria kit.

2. Description of the Prior Art

During festive times, such as Christmas Eve, it is common practice to use luminarias to outline the pathway to one's home.

A luminaria usually is made by placing an open bag on the ground with its open end facing up, placing sand in the bag, and then placing a candle into the bag and pushing the bottom end of the candle into the sand so that the candle stands erect in the bag.

The purpose of the sand is to support the candle in an upright position and to weigh the bag down so that the luminaria is not blown around by the wind.

The candle is then lighted. With the candle lighted, the luminaria glows.

A problem with such luminarias is that they are potential fire hazards. For instance, if not enough sand is placed into the bag, or if the candle is not placed into the sand properly, the candle is prone to tip over into contact with the bag and ignite the bag. Further, since no affirmative measures are usually taken to extinguish the candle's flame, it is possible for the bottom of the bag to catch on fire when the candle burns down to its bottom end.

Another problem with such luminarias is that storing, handling, and disposing of the sand is burdensome.

SUMMARY OF THE INVENTION

It is an object of the invention to provide a luminary candle base for holding a candle for use in a luminaria.

Another object of the invention is to provide a luminary candle base that automatically extinguishes the candle.

Another object of the invention is to eliminate the need for sand in luminarias.

Another object is to provide a lightweight luminary candle base.

A further object of the invention is to provide a luminaria kit having a safety feature of automatically extinguishing the candle when the candle burns down.

These and other objects of the invention are accomplished by providing a luminary candle base in the form of a hollow plastic container for holding water and a candle for use in a luminaria. The plastic container has a bottom wall, a top wall, four side walls extending between the top wall and the bottom wall, and candle securing means for securing the candle in an upright position in the container. The candle securing means includes a well formed in the bottom wall of the container into which the candle is inserted. The top wall has an opening above and aligned with the well to permit the candle to be inserted into the well, to permit the candle to extend from the container, and to permit insertion of water into the container.

The invention provides for the automatic extinguishing of the flame of the candle when the candle burns down to the point to where the water held in the container contacts the flame.

DETAILED DESCRIPTION

Figure 1:
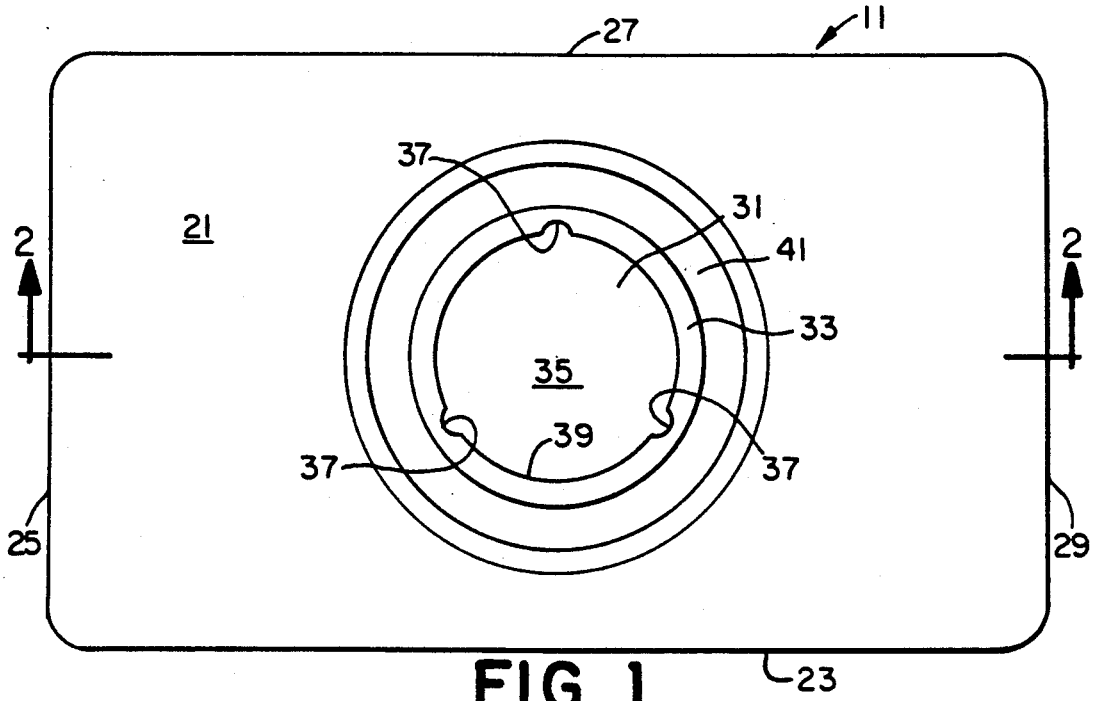
FIG. 1 is a view in top plan of a hollow plastic container for holding water and a candle for use in a luminaria constructed in accordance with this invention.
Figure 2:
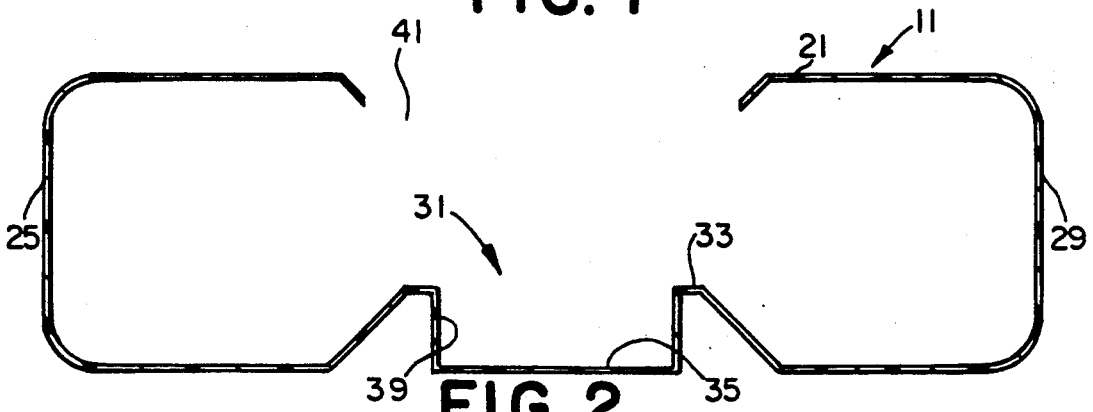
FIG. 2 is a view in section taken as indicated by the lines and arrows 2—2 that appear in FIG. 1.

Turning to the drawings, there is shown a luminary candle base in the form of a hollow molded non-flammable plastic liquid-tight container 11 for holding water 13 and a candle 15 in a luminaria 17. Container 11 has a bottom wall 19, a top wall 21, and four side walls 23, 25, 27, and 29 extending between the bottom wall 19 and the top wall 21.

Figure 3:
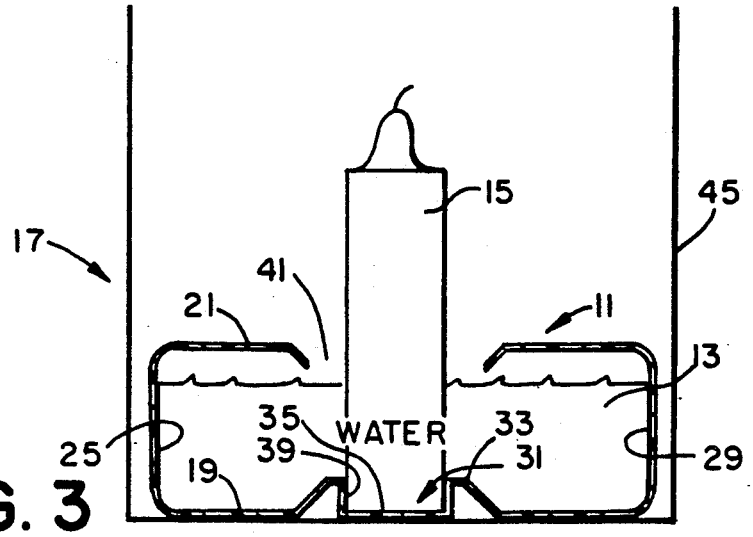
FIG. 3 is a view in cross-section of a luminaria constructed in accordance with this invention.

In the bottom wall 19 of the container 11, there is formed a well 31 into which the candle 15 is inserted. As shown in FIG. 3, well 31 acts as a candle securing means for securing the candle 15 in an upright position in the container 11.

Well 31 is formed by an upwardly extending annular ridge 33 formed in the bottom wall 19 of container 11 and a portion 35 of bottom wall 19 surrounded by ridge 33. The portion 35 of bottom wall 19 surrounded by the ridge 33 is in a plane that is level with or above the plane of the remainder of the bottom wall 19 of container 11 so that container 11 has a stable base when in use. If the portion 35 of bottom wall 19 protruded below the plane of the remainder of the bottom wall 19, that is, if the bottom of the well 31 protruded past the remainder of bottom wall 19, the container 11 would be unstable and prone to tilting over.

Three channels 37 are formed in the inner wall 39 of annular ridge 33 and extend from the bottom of the well 31, that is, portion 35 of bottom wall 19, to the top of the ridge 33 to permit air to escape from well 31 as the candle 15 is being inserted into the well 31.

An opening 41 is formed in top wall 21 above and aligned with the well 31 to permit the candle 15 to be inserted into the well 31, to permit the candle 15 to extend from the container 11, and to permit the insertion of water 13 into the container 11.

An assembled luminaria 17 is shown in FIG. 3, assembled from a luminaria kit comprising a luminaria bag 45 for holding the container 11, container 11, and candle 15.

In operation, candle 15 is inserted through opening 41 in top wall 21 into well 31 such that the bottom portion of candle 15 fits snugly against the inner wall 39 of ridge 33 and against portion 35 of bottom wall 19. Air that is trapped between the bottom portion of candle 15 and the inside of well 31 escapes through channels 37.

Water 13 is then added to container 11. Preferably, water 13 is added until three-quarters of container 11 is filled.

Container 11, with water 13 and candle 15, is then placed in luminaria bag 45, and candle 15 is then ignited, causing luminaria 17 to give off a glow.

The flame of candle 15 is automatically extinguished when the candle 15 burns down to the point where the water 13 held in container 11 contacts the flame.

The water 13 held in container 11, in addition to acting as a fire extinguishing agent, also acts as a stabilizer for the container 11 since the weight of the water 13 stabilizes container 11 to guard against the luminaria 17 tipping over.

Further, the water 13 acts as a weight to hold the luminaria 17 in place and prevent it from being blown around by the wind.

The term "plastic" is used herein in its most common sense, and refers to synthetic resins which are moldable in various forms and are hardened for commercial use.

Preferably, container 11 is made of seven parts high density polyethylene and one part flame retardant. An example of such a flame retardant is Concentrate 61 made by Monmouth Plastics Inc., Asbury Park, N.J.

Preferably, the container 11 is 5½ inches long by 3¼ inches wide by 1¾ high, weighs about 30 grams, and fits in a standard #6 bag 45. Since container 11 is made of a lightweight plastic, it is inexpensive to ship and to store.

I claim:

1. A luminaria candle base for holding water and a candle for use in a luminaria comprising a bottom wall, a top wall, four side walls extending between the bottom wall and the top wall to form a container for holding water, a candle, candle securing means for securing the candle in an upright position in the container, the candle securing means including a well formed in and being integral with the bottom wall into which the candle is inserted, the top wall having an opening above and aligned with the well to permit the candle to be inserted into the well, to permit the candle to extend from the container, and to permit insertion of water into the container, and fire extinguishing and stabilizing means for extinguishing the flame of the candle when the candle burns down and for stabilizing the container to guard against the container tipping over, said fire extinguishing and stabilizing means being water held in the container.

2. The container of claim 1, said container being made of high density polyethylene.

3. The container of claim 1, said container being made of high density polyethylene with a flame retardant added thereto.

4. The container of claim 1, the well being formed by an upwardly extending annular ridge formed in the bottom wall of the container and a portion of the bottom wall surrounded by the ridge, said portion being in a plan level with the plane of the remainder of the bottom wall of the container.

5. A hollow plastic container for holding water and a candle for use in a luminaria comprising a bottom wall, a top wall, four side walls extending between the bottom wall and the top wall, and candle securing means for securing a candle in an upright position in the container, the candle securing means including a well formed in the bottom wall into which the candle is inserted, the top wall having an opening above and aligned with the well to permit the candle to be inserted into the well, to permit the candle to extend from the container, and to permit insertion of water into the container, the well being formed by an upwardly extending annular ridge formed in the bottom wall of the container and a portion of the bottom wall surrounded by the ridge, said portion being in a plane level with the plane of the remainder of the bottom wall of the container, the annular ridge having an inner wall, and a channel formed in the inner wall of the ridge extending from the portion of the bottom wall surrounded by the ridge to the top of the ridge to permit air to escape from the well as the candle is being inserted into the well.

6. A hollow plastic container for holding water and a candle for use in a luminaria comprising a bottom wall, a top wall, four side walls extending between the bottom wall and the top wall, and candle securing means for securing a candle in an upright position in the container, the candle securing means including a well formed in the bottom wall into which the candle is inserted, the top wall having an opening above and aligned with the well to permit the candle to be inserted into the well, to permit the candle to extend from the container, and to permit insertion of water into the container, said container being made of high density polyethylene with a flame retardant added thereto, the well being formed by an upwardly extending annular ridge formed in the bottom wall of the container and a portion of the bottom wall surrounded by the ridge, the annular ridge having an inner wall, and a channel formed in the inner wall of the ridge extending from the portion of the bottom wall surrounded by the ridge to the top of the ridge to permit air to escape from the well as the candle is being inserted into the well.

7. A luminaria kit comprising a luminaria bag, a candle, and a hollow plastic container for holding water and the candle, said container comprising a bottom wall, a top wall, four side walls extending between the bottom wall and the top wall, and candle securing means for securing the candle in an upright position in the container, the candle securing means including a well formed in the bottom wall into which the candle is inserted, the top wall having an opening above and aligned with the well to permit the candle to be inserted into the well, to permit the candle to extend from the container, and to permit insertion of water into the container.

8. The luminaria kit of claim 7, said container being made of high density polyethylene.

9. The luminaria kit of claim 7, said container being made of high density polyethylene with a flame retardant added thereto.

10. A luminaria kit comprising a luminaria bag, a candle, and a hollow plastic container for holding water and the candle, said container comprising
a bottom wall,
a top wall,
four side walls extending between the bottom wall and the top wall, and
candle securing means for securing the candle in an upright position in the container, the candle securing means including a well formed in the bottom wall into which the candle is inserted,
the top wall having an opening above and aligned with the well to permit the candle to be inserted into the well, to permit the candle to extend from the container, and to permit insertion of water into the container,
the well being formed by an upwardly extending annular ridge formed in the bottom wall of the container and a portion of the bottom wall surrounded by the ridge,
said portion being in a plane level with the plane of the remainder of the bottom wall of the container.

11. The luminaria kit of claim 10,
the annular ridge having an inner wall, and
a channel formed in the inner wall of the ridge extending from the portion of the bottom wall surrounded by the ridge to the top of the ridge to permit air to escape from the well as the candle is being inserted into the well.

12. A luminaria kit comprising
a luminaria bag,
a candle, and
a hollow plastic container for holding water and the candle,
said container comprising
a bottom wall,
a top wall,
four side walls extending between the bottom wall and the top wall, and
candle securing means for securing the candle in an upright position in the container, the candle securing means including a well formed in the bottom wall into which the candle is inserted,
the top wall having an opening above and aligned with the well to permit the candle to be inserted into the well, to permit the candle to extend from the container, and to permit insertion of water into the container,
said container being made of high density polyethylene with a flame retardant added thereto,
the well being formed by an upwardly extending annular ridge formed in the bottom wall of the container and a portion of the bottom wall surrounded by the ridge,
the annular ridge having an inner wall, and
a channel formed in the inner wall of the ridge extending from the portion of the bottom wall surrounded by the ridge to the top of the ridge to permit air to escape from the well as the candle is being inserted into the well.

13. A luminaria comprising
a bag,
a luminaria candle base positioned in the bag for holding water and a candle, the luminaria candle base having a bottom wall, and a side wall extending upwardly from the bottom wall to form a container for holding water,
a candle,
candle securing means for securing the candle in an upright position in the container, the candle securing means including a well formed in and being integral with the bottom wall into which the candle is inserted, and
fire extinguishing and stabilizing means for extinguishing the flame of the candle when the candle burns down and for stabilizing the container to guard against the container tipping over, said fire extinguishing and stabilizing means being water held in the container.

14. The container of claim 1,
the well being formed by an upwardly extending annular ridge formed in the bottom wall of the container and a portion of the bottom wall surrounded by the ridge,
said portion being in a plane above the plane of the remainder of the bottom wall of the container.

15. The container of claim 6,
said portion of the bottom wall surrounded by the ridge being in a plane level with the plane of the remainder of the bottom wall of the container.

16. The container of claim 6,
said portion of the bottom wall surrounded by the ridge being in a plane above the plane of the remainder of the bottom wall of the container.

17. The luminaria kit of claim 12,
said portion of the bottom wall surrounded by the ridge being in a plane level with the plane of the remainder of the bottom wall of the container.

18. The luminaria kit of claim 12,
said portion of the bottom wall surrounded by the ridge being in a plane above the plane of the remainder of the bottom wall of the container.

19. A hollow plastic container for holding water and a candle for use in a luminaria comprising
a bottom wall,
a top wall,
four side walls extending between the bottom wall and the top wall, and
candle securing means for securing a candle in an upright position in the container, the candle securing means including a well formed in the bottom wall into which the candle is inserted,
the top wall having an opening above and aligned with the well to permit the candle to be inserted into the well, to permit the candle to extend from the container, and to permit insertion of water into the container,
the well being formed by an upwardly extending annular ridge formed in the bottom wall of the container and a portion of the bottom wall surrounded by the ridge,
said portion being in a plane above the plane of the remainder of the bottom wall of the container, and
the annular ridge having an inner wall, and
a channel formed in the inner wall of the ridge extending from the portion of the bottom wall surrounded by the ridge to the top of the ridge to permit air to escape from the well as the candle is being inserted into the well.

20. A luminaria kit comprising
a luminaria bag,
a candle, and
a hollow plastic container for holding water and the candle,
said container comprising
a bottom wall,
a top wall, four side walls extending between the bottom wall and the top wall, and candle securing means for securing the candle in an upright position in the container, the candle securing means including a well formed in the bottom wall into which the candle is inserted, the top wall having an opening above and aligned with the well to permit the candle to be inserted into the well, to permit the candle to extend from the container, and to permit insertion of water into the container, the well being formed by an upwardly extending annular ridge formed in the bottom wall of the container and a portion of the bottom wall surrounded by the ridge, said portion being in a plane above the plane of the remainder of the bottom wall of the container.

21. The luminaria kit of claim 20, the annular ridge having an inner wall, and a channel formed in the inner wall of the ridge extending from the portion of the bottom wall surrounded by the ridge to the top of the ridge to permit air to escape from the well as the candle is being inserted into the well.

* * * * *